US007593668B2

(12) United States Patent
Yokota et al.

(10) Patent No.: US 7,593,668 B2
(45) Date of Patent: Sep. 22, 2009

(54) IMAGE FORMING APPARATUS WITH ADJUSTING PORTIONS TO ADJUST POSITIONS OF CONVEYING AND DISCHARGE PORTIONS

(75) Inventors: Masahiko Yokota, Abiko (JP); Toshiyuki Nagano, Kawasaki (JP); Hiroaki Miyake, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 11/690,298

(22) Filed: Mar. 23, 2007

(65) Prior Publication Data

US 2007/0230995 A1 Oct. 4, 2007

(30) Foreign Application Priority Data

Mar. 30, 2006 (JP) ..... 2006-093633

(51) Int. Cl.
*G03G 15/00* (2006.01)

(52) U.S. Cl. ..... 399/126; 399/107

(58) Field of Classification Search ..... 399/107, 399/109, 110, 126
See application file for complete search history.

(56) References Cited

U.S. PATENT DOCUMENTS 4,234,305 A 11/1980 Miyake et al. ..... 432/59
5,008,711 A 4/1991 Sakamoto et al.
5,043,770 A 8/1991 Nagano et al.
5,205,551 A 4/1993 Nagano et al. ..... 271/225
5,303,010 A * 4/1994 Takano et al. ..... 399/126
5,775,686 A 7/1998 Miyake ..... 271/127
6,224,052 B1 5/2001 Nagano ..... 271/127
6,289,183 B1 9/2001 Miyake ..... 399/16
6,398,212 B1 6/2002 Miyake ..... 271/186
6,402,133 B1 6/2002 Miyake ..... 271/3.19
6,408,146 B1 6/2002 Nagano ..... 399/67
6,522,862 B2 2/2003 Koshimizu et al. ..... 399/405
6,674,979 B2 1/2004 Nagano ..... 399/68
6,775,515 B2 * 8/2004 Ouchi ..... 399/107 X
6,836,642 B2 12/2004 Miyake ..... 399/401
6,983,113 B2 * 1/2006 Yamamoto et al. ..... 399/109
7,055,820 B2 * 6/2006 Saito et al. ..... 399/107 X
7,450,881 B2 * 11/2008 Kenji et al. ..... 399/110

FOREIGN PATENT DOCUMENTS

JP 64-26865 1/1989

* cited by examiner

*Primary Examiner*—Sandra L Brase
(74) *Attorney, Agent, or Firm*—Fitzpatrick, Cella, Harper & Scinto

(57) ABSTRACT

Provided is an image forming apparatus capable of mounting an internal unit in a main body chassis thereof, in which a position of a sheet conveying portion for conveying a sheet to the internal unit, with respect to the internal unit is adjusted by a first adjustment portion, and a position of a sheet discharge portion which discharges the sheet having an image formed thereon, with respect to the internal unit is adjusted by a second adjustment portion.

14 Claims, 10 Drawing Sheets

IMAGE FORMING APPARATUS WITH ADJUSTING PORTIONS TO ADJUST POSITIONS OF CONVEYING AND DISCHARGE PORTIONS

BACKGROUND OF THE INVENTION

1. Field of the Invention

The present invention relates to an image forming apparatus, and more particularly, to a structure for accommodating different types of image forming units in an apparatus main body.

2. Description of the Related Art

A conventional image forming apparatus includes an image forming unit for forming an image on a sheet. The image forming unit includes elements such as an image writing unit including a laser scanner and an LED array, a photosensitive drum, primary and secondary chargers, a toner supply unit, a transfer unit, a toner collecting/cleaning unit, an image fixing unit, a drive unit, and a sheet conveying unit.

As examples of the image forming unit, there are known an image forming unit of a monochromatic electrophotographic system using one photosensitive drum, an image forming unit of a tandem-type color electrophotographic system using a plurality of photosensitive drums arranged in series, and an image forming unit of a rotary-type color electrophotographic system using a plurality of photosensitive drums to be rotated.

Up to now, there is one type of an image forming apparatus from which an image forming unit can be removed to an outside to be, for example, replaced with another image forming unit or repaired when a life of the image forming unit comes to an end. In the image forming apparatus, for example, an indication is given when the replacement of the imaging unit serving as a component of the image forming unit is required because of the end of the life thereof, and the imaging unit and the photosensitive drum are detachably mounted on the apparatus main body. Japanese Patent Application Laid-Open No. 64-26865 discloses an example of the image forming apparatus having such a structure.

In the conventional image forming apparatus including the image forming unit mounted in a replaceable manner, the replacement or the like of the image forming unit is possible. However, the image forming apparatus is not ready for a wide variety of the products (image forming unit) manufactured in recent years. In other words, while there are various image forming units using the electrophotographic systems mentioned above in a case where the electrophotographic systems to be used in the image forming units are different from each other, a position and direction into which a sheet enters and a position and direction into which a sheet is discharged are also different. In addition, a position of a heat source such as a fixing device, conditions of airflow (air pressure gradient) by the components are different from one system to another.

For this reason, it is difficult to entirely remove the image forming unit from the apparatus main body to incorporate another image forming unit having a different structure in the apparatus main body. Therefore, when, for example, the apparatus main body is recovered and a frame of the apparatus main body, that is, a support of the image forming unit is to be recycled, it is necessary to individually design the support in compliance with the type of an image forming unit to be newly incorporated in the apparatus main body.

Specifically, in the conventional image forming apparatus, even when the apparatus main body is to be recycled by replacing the image forming unit with another image forming unit, it is difficult to receive an image forming unit having a different structure from that of the image forming unit used until being recovered, in the apparatus main body. As a result, reuse of (the frame of) the apparatus main body or common use thereof cannot be achieved. Further, in a case where one apparatus main body is reused by another apparatus, there are problems in that, for example, a large number of designing steps are required, and management costs for the recycling are increased.

SUMMARY OF THE INVENTION

The present invention has been made in view of the above-mentioned circumstances, and therefore, an object of the present invention is to provide an image forming apparatus capable of selectively mounting different image forming units having different structures.

According to the present invention, there is provided an image forming apparatus including: an image forming unit; an apparatus main body which is capable of mounting the image forming unit; a sheet conveying portion which is provided to the apparatus main body, and conveys a sheet to the image forming unit; a sheet discharge portion which is provided to the apparatus main body, and discharges the sheet on which an image is formed by the image forming unit; a first adjustment portion which adjusts a connecting position of the sheet conveying portion with respect to the image forming unit mounted on the apparatus main body; and a second adjustment portion which adjusts a connecting position of the sheet discharge portion with respect to the image forming unit mounted on the apparatus main body.

Further, according to the present invention, there is provided an image forming apparatus, comprising: an apparatus main body capable of selectively mounting different image forming units of different types; a sheet conveying portion which is provided to the apparatus main body, and conveys a sheet to the image forming unit mounted on the apparatus main body; a sheet discharge portion which is provided to the apparatus main body, and discharges the sheet on which an image is formed by the image forming unit mounted on the apparatus main body; a first adjustment portion which adjusts a connecting position of the sheet conveying portion with respect to the image forming unit mounted on the apparatus main body; and a second adjustment portion which adjusts a connecting position of the sheet discharge portion with respect to the image forming unit mounted on the apparatus main body.

Further features of the present invention will become apparent from the following description of exemplary embodiments with reference to the attached drawings.

DESCRIPTION OF THE EMBODIMENTS

Hereinafter, best embodiment modes for carrying out the present invention will be described with reference to the drawings.

Figure 1:
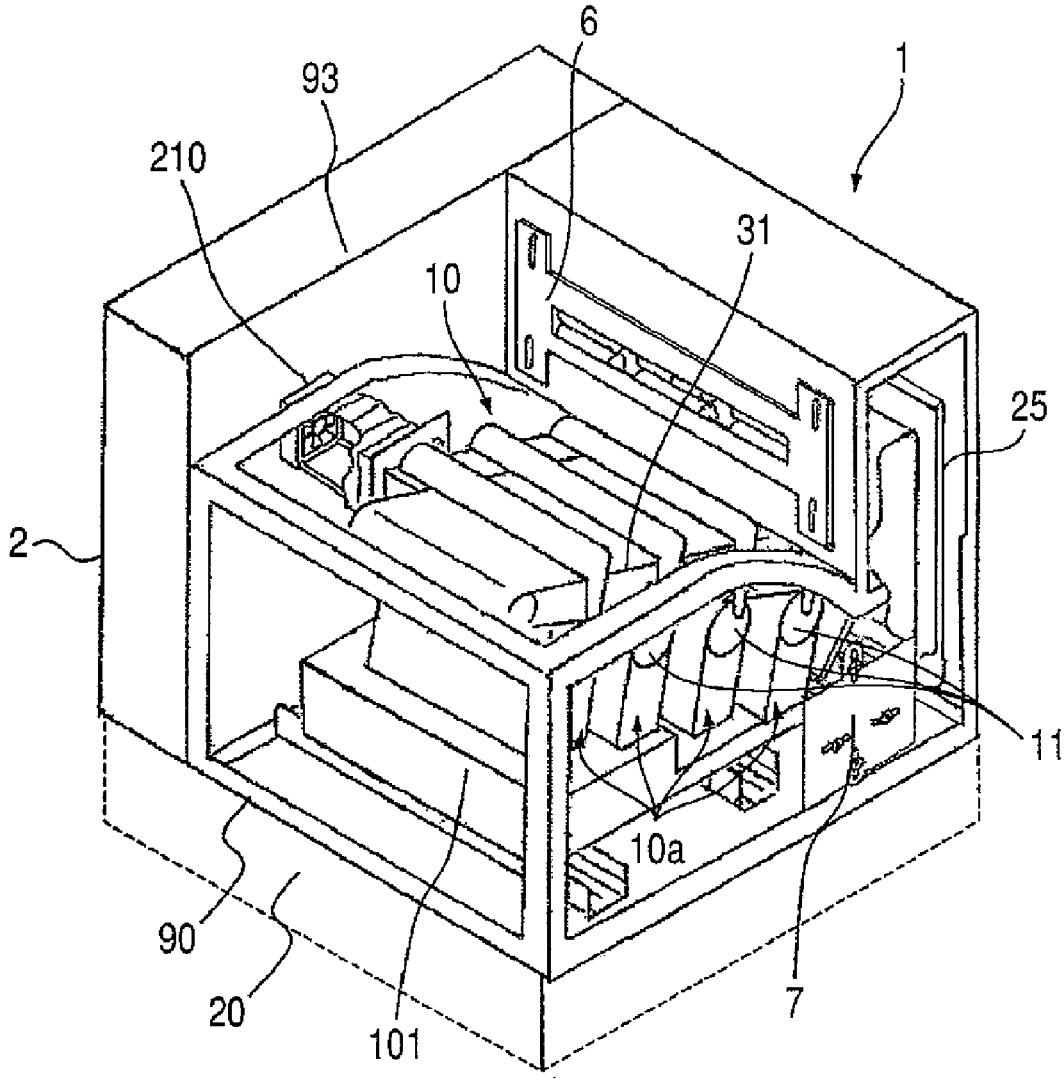
FIG. 1 is an appearance schematic view in which an exterior of a color printer, which is an example of an image forming apparatus according to an embodiment of the present invention, is removed.
Figure 2:
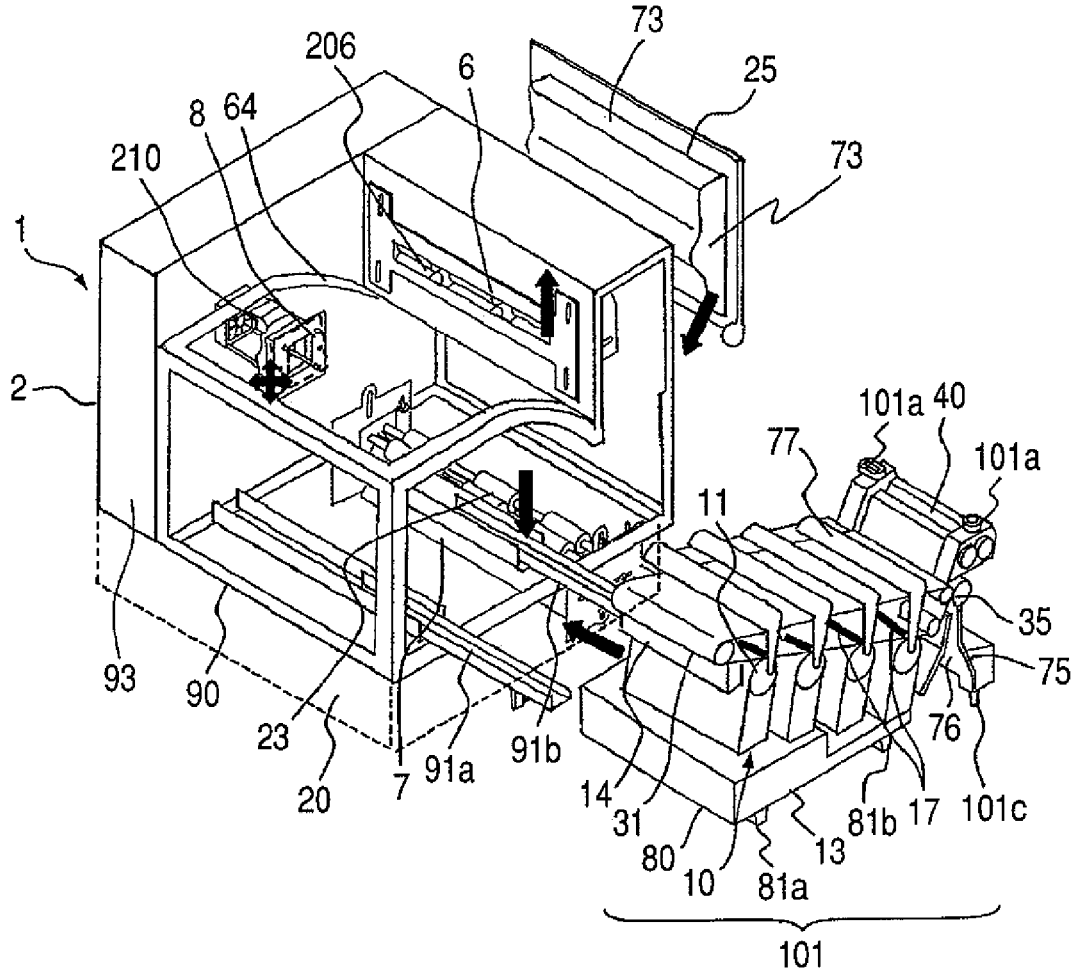
FIG. 2 is a perspective view illustrating a state where an image forming unit of the color printer is drawn out.

FIG. 1 is an appearance schematic view in which an exterior of a color printer, which is an example of an image forming apparatus according to an embodiment of the present invention, is removed. FIG. 2 is a perspective view illustrating a state where an image forming unit of the color printer is drawn out. The color printer is a 4-drum full color printer using an intermediate transferring belt.

As illustrated in FIGS. 1 and 2, the image forming apparatus includes a color printer 1, a color printer main body 2, an image forming unit 10 including drum units 10*a* for four colors of yellow (Y), magenta (M), cyan (C), and black (Bk), an intermediate transferring belt 31 serving as an intermediate transfer member, and a fixing device 40. The drum units 10*a* for four colors are arranged in parallel with each other along the intermediate transferring belt 31, and includes photosensitive drums 11 serving as image bearing members. Further, on outer peripheral surfaces of the photosensitive drums 11, there are provided a primary charger (not shown) for uniformly charging the surfaces of the photosensitive drums 11, and a developing device 14 for developing an electrostatic latent image formed on the surface of the photosensitive drum through exposure by a laser scanner 13.

Then, in the color printer 1 having the above-mentioned structure, when an image forming operation is started, in, for example, the drum unit for yellow, the surface of the photosensitive drum 11 is first uniformly negatively charged by the primary charger. After that, image exposure is performed by the laser scanner 13, thereby forming an electrostatic latent image corresponding to a yellow image component on the surface of the photosensitive drum 11. Then, the electrostatic latent image is developed using negatively charged yellow toner by the developing device 14, and is visualized as a yellow toner image. The yellow toner image thus obtained is primarily transferred onto the intermediate transferring belt 31 by a primary transfer blade 17.

Then, the toner image forming operation is performed at a predetermined timing in the other drum units, and toner images formed on the photosensitive drums 11 are sequentially superimposed on the intermediate transferring belt 31 to be primarily transferred by the primary transfer blade 17. Next, the four toner images transferred onto the intermediate transferring belt 31 are moved to a secondary transfer portion including the intermediate transferring belt 31 and a secondary transfer roller 35 through rotation of the intermediate transferring belt 31.

On the other hand, a sheet is fed from a cassette 20 or a multi-feed tray 25 in parallel with the toner image forming operation, and the sheet is conveyed to the secondary transfer portion in synchronization with the toner image formed on the intermediate transferring belt 31 by a registration roller pair 23 of FIG. 6 to be described later.

Then, after the color toner images are formed in the manner as described above, in a case where the toner image is formed only on one surface of the sheet, the sheet is discharged to a discharge portion 64 disposed on an upper surface of the apparatus main body 2 through discharge rollers 206 by switching a change flapper 61 of FIG. 5 to be described later.

On the other hand, in a case where the toner image is formed on both surfaces of the sheet, the sheet onto which the toner image is fixed by the fixing device 40 is conveyed in a direction of the discharge portion 64 by the discharge rollers 206, and the discharge rollers 206 are reversely rotated after a trailing edge of the sheet has passed through the flapper 61.

In this case, after the trailing edge of the sheet has passed through the flapper 61, the flapper 61 is moved downward by its own weight to open a duplex conveying path 70 of FIG. 5 to be described later. Thus, through the reverse rotation of the discharge rollers 206, the sheet is conveyed to the duplex conveying path 70. After that, through the reverse rotation of the discharge rollers 206, the sheet reaches the registration roller pair 23 through a conveying path 73 forming a re-conveying path with the duplex conveying path 70. At this time, the surfaces of the sheet are reversed, and an image is formed on the other side of the sheet through the process similar to that of the one-side image forming process described above.

An internal unit 101 is a tandem type serving as the image forming unit of the present invention, and a discharge unit 6 includes the discharge rollers 206. A registration unit 7 includes the registration roller pair 23, and a main body chassis 90 forms the apparatus main body. An internal unit 101 is provided to the main body chassis 90 in a replaceable manner. The discharge unit 6 serving as a sheet discharge portion, the registration unit 7 serving as a sheet conveying portion, and a fan duct 210 serving as an exhaust unit are mounted on the main body chassis 90 so as to be adjusted slidably in a vertical direction and a horizontal direction.

The internal unit 101 includes an image forming unit 10 having the above-mentioned four drum units 10*a* for four colors arranged in parallel with each other with respect to each shaft of the photosensitive drums 11, and the laser scanner 13.

Further, the internal unit 101 includes a drive unit (not shown) including the intermediate transferring belt 31, the secondary transfer roller 35 for transferring the four color toner images formed on the intermediate transferring belt 31 onto the sheet, the fixing device 40, and a motor for rotationally driving the photosensitive drums 11, the transferring belt 31, and the fixing device 40.

Further, the internal unit 101 includes a hopper (not shown) for supplying toner to the developing device 14 and toner bottles 77, a cleaning unit (not shown) for cleaning and collecting toner remaining on the surface of the intermediate transferring belt 31, and a toner collecting device.

Further, the internal unit 101 includes a fixing entrance guide (not shown) for guiding the sheet from the secondary transfer roller 35 to the fixing device 40, a transfer entrance guide 75 forming an entrance of a transfer path 76 through which the sheet passes after passing through the registration roller pair 23, and a printer support casing 80 for supporting these members.

In this case, as illustrated in FIG. 2, in the fixing device 40, which forms an upper surface of the printer support casing 80 of the internal unit 101, a positioning hole 101*a* is formed, and two protrusions 81*a* and 81*b* are formed on a bottom surface of the printer support casing 80. In addition, two positioning holes 101*c* are formed on a bottom surface of the transfer entrance guide 75. One of the positioning holes 101*c* is not illustrated.

Further, in a lower part of the main body chassis 90, rails 91*a* and 91*b* serving as guide units arranged in parallel with each other are provided. The rails 91*a* and 91*b* are formed by coupling two or three stages of metal rails to each other in an expandable manner.

Fitting holes (not shown) formed in the rails 91*a* and 91*b* are fitted with the protrusions 81*a* and 81*b* formed on the bottom surface of the printer support casing 80, thereby making it possible to accommodate the internal unit 101 in the main body chassis 90 in a drawable manner while the internal unit 101 is moved horizontally. When the internal unit 101 is removed, the internal unit 101 together with the rails 91*a* and 91*b* are drawn out from the main body chassis 90, and then the fitting with the rails 91*a* and 91*b* is released.

Figure 3:
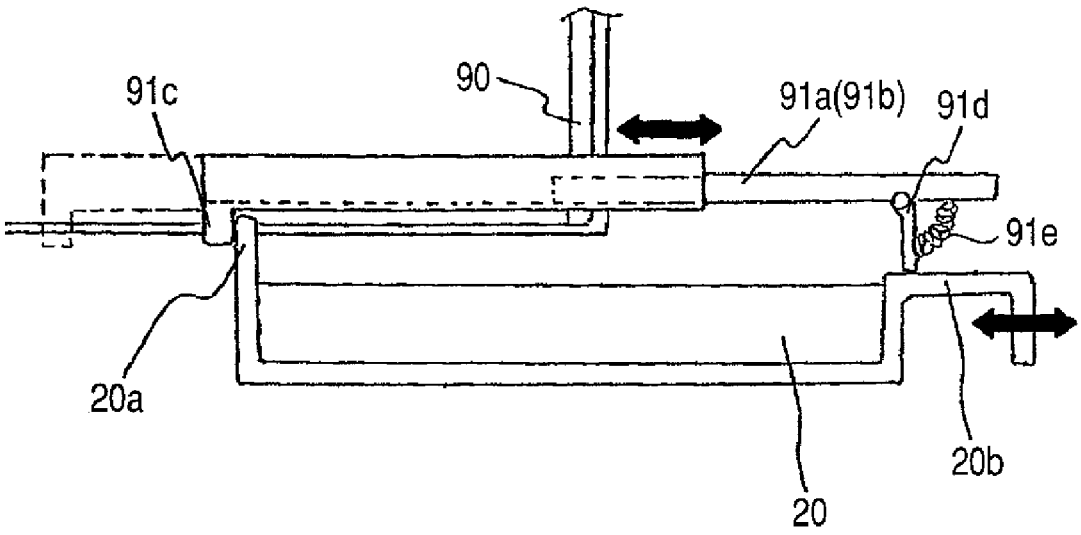
FIG. 3 is an explanatory diagram of a structure in which an internal unit having the image forming unit of the color printer is drawn out.

In this case, as illustrated in FIG. 3, at rear ends of the rails 91*a* and 91*b* on a side of a drawing-out direction, a removal-preventive protrusion 91*c* is provided. In this embodiment, a sheet feed cassette 20 is mounted on the apparatus main body 2 (main body chassis 90) in a drawing-out direction of the internal unit 101 in a drawable manner.

When the sheet feed cassette 20 is mounted to the apparatus main body 2, the removal-preventive protrusion 91*c* is engaged with a rear end engaging protrusion 20*a*, thereby preventing the rails 91*a* and 91*b* from being removed. Thus, the rails 91*a* and 91*b* cannot be drawn out unless the sheet feed cassette 20 is drawn out. In other words, in order to draw out the internal unit 101, it is necessary to draw out the sheet feed cassette 20.

At tip ends of the rails 91*a* and 91*b* on a downstream side of the drawing-out direction, there is provided a support portion 91*d* which is brought into contact with a handle 20*b* of the sheet feed cassette 20 when the rails 91*a* and 91*b* are drawn out together with the internal unit 101 after the sheet feed cassette 20 is drawn out. When the rails 91*a* and 91*b* are drawn out, the support portion 91*d* is brought into contact with the rails 91*a* and 91*b* by the sheet feed cassette 20 from a lower part thereof, thereby making it possible to support the rails 91*a* and 91*b* by the sheet feed cassette 20 from the lower part thereof. As s result, the internal unit 101 can be replaced and mounted in a state where the rails 91 and 91*b* are stabilized.

When the internal unit 101 is accommodated in the main body chassis 90, the rails 91*a* and 91*b* are moved along with the internal unit 101 while the rails 91*a* and 91*b* are slid in a state where the internal unit 10 is drawn out. At this time, the support portion 91*d* is moved out of the way of the sliding of the rails against a spring 91*e*.

Figure 4:
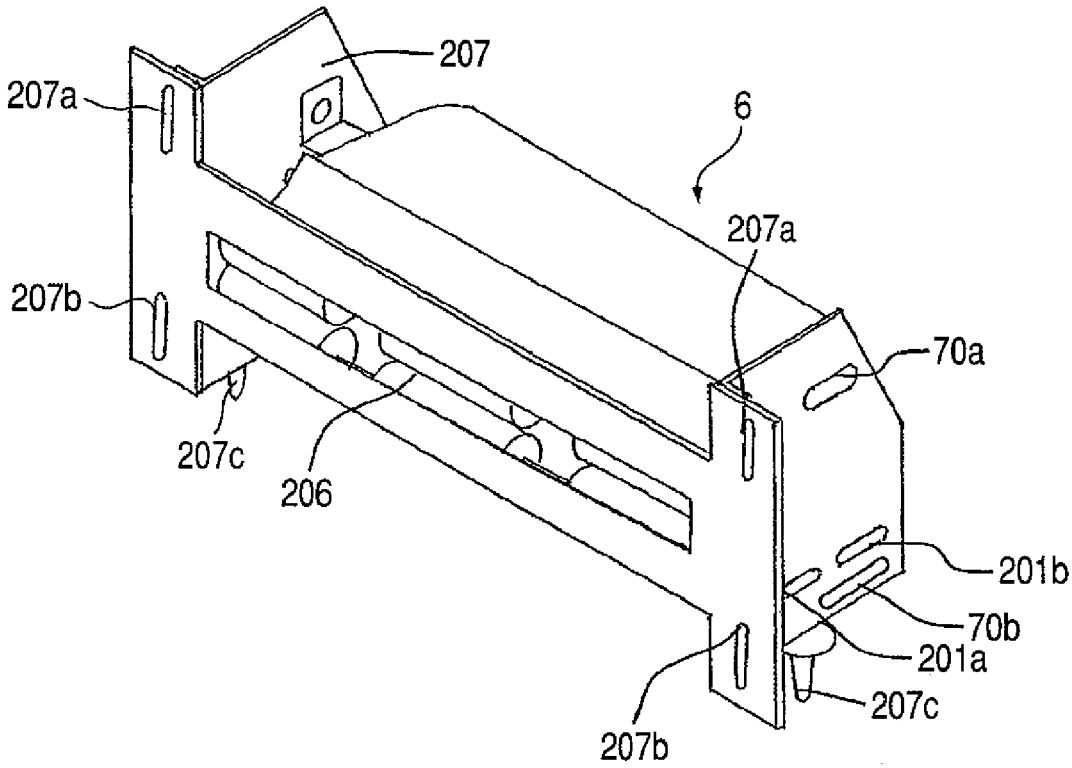
FIG. 4 is a perspective view of a sheet discharge unit provided in a main body chassis of the color printer.
Figure 5:
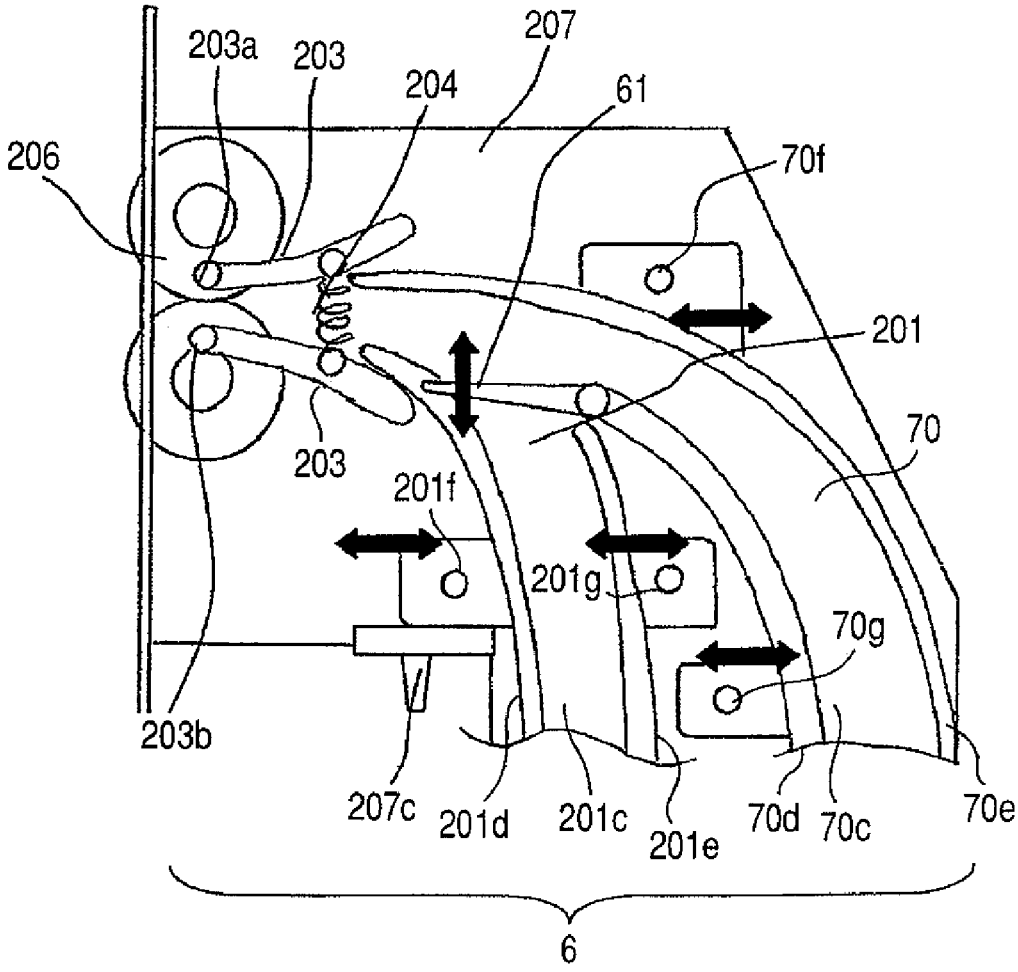
FIG. 5 is an explanatory diagram of a structure of the sheet discharge unit.

FIG. 4 is a perspective view of the sheet discharge unit 6 provided in the main body chassis, and FIG. 5 is an explanatory diagram of the structure of the sheet discharge unit 6. The sheet discharge unit 6 serving as a sheet discharge portion includes a housing 207 serving as a first adjustment portion, a discharge roller pair 206, a discharge conveying path 201 serving as a sheet discharge path, and a duplex conveying path 70.

In this case, guide members 201*d* and 201*e* forming the discharge conveying path 201 are movable in a horizontal direction with respect to the housing 207 through two long holes 201*a* and 201*b* that are provided in the housing 207 and extend in the horizontal direction. Further, guide members 70*d* and 70*e* forming the duplex conveying path 70 are also movable in the horizontal direction with respect to the housing 207 through two long holes 201*a* and 201*b* that are provided in the housing 207 and extend in the horizontal direction.

Shafts 70*f* and 70*g* illustrated in FIG. 5 are respectively provided to the guide members 70*d* and 70*e* forming the duplex conveying path 70. The shafts 70*f* and 70*g* are inserted in the long holes 70*a* and 70*b*, respectively, thereby making it possible to move the guide members 70*d* and 70*e* (duplex conveying path 70) in the horizontal direction. Shafts 201*f* and 201*g* are respectively provided to the guide members 201*d* and 201*e* forming the discharge conveying path 201. The shafts 201*f* and 201*g* are inserted in the long holes 201*a* and 201*b*, respectively, thereby making it possible to move the guide members 201*d* and 201*e* (discharge conveying path 201) in the horizontal direction.

On the other hand, the housing 207 is provided with long holes 207*a* and 207*b* extending in the vertical direction. The long holes 207*a* and 207*b* are engaged with engaging portions (not shown) provided in the main body chassis 90, thereby making it possible to move the housing 207 in a vertical direction with respect to the main body chassis 90. Specifically, the long holes 207*a* and 207*b* are engaged with the engaging portions provided in the main body chassis 90, thereby making it possible to move the duplex conveying path 70 and the discharge conveying path 201 in the vertical direction together with the housing 207.

Thus, the duplex conveying path 70 and the discharge conveying path 201 are provided to the housing 207 having the long holes 70*a*, 70*b*, 201*a*, 201*b*, 207*a*, and 207*b*, thereby making it possible to move the duplex conveying path 70 and the discharge conveying path 201 in the vertical and horizontal directions.

On a lower surface of the housing 207, there are provided an opening portion 201*c* for guiding a sheet conveyed from the fixing device 40 into the discharge roller pair 206, and an opening portion 70*c* for sending out the sheet to a conveying path 73 (see FIG. 2). Further, on the lower surface of the housing 207, there is formed a positioning protrusion 207*c* which is fitted into the positioning hole 101*a* (see FIG. 2) formed in an upper part of the internal unit 101, and positions the discharge unit 6.

In a case of replacing the internal unit 101 or accommodating an internal unit 102 having another structure illustrate in FIG. 10 to be described later in placed of the internal unit 101, the internal unit 101 is first removed. Next, before the internal unit 101 or the internal unit 102 having another structure (hereinafter, referred to as "internal unit 101 or the like") is accommodated in the main body chassis 90, the discharge unit 6 (housing 207) is evacuated upward along the long holes 207*a* and 207*b*.

Then, after the internal unit 101 are accommodated in the main body chassis 90, the duplex conveying path 70 and the discharge conveying path 201 are moved along the long holes 70*a*, 70*b*, 201*a*, and 201*b* to a position facing the fixing device 40 and the conveying path 73 of the internal unit 101. After that, the positioning protrusion 207*c* is fitted into the positioning hole 101*a* of the internal unit 101.

Thus, the positioning of the discharge unit 6 in the vertical and horizontal directions with respect to the internal unit 101 or the like is made. As a result, the opening portion 201*c* of the discharge conveying path 201 and the opening portion 70*c* of the duplex conveying path 70 are engaged with an outlet of the fixing device 40 and the conveying path 73 of the internal unit 101, respectively, so as to be fixed to each other. In this embodiment, the opening portion 201*c* of the discharge conveying path 201 and the opening portion 70*c* of the duplex conveying path 70 each function as a sheet conveying interface with respect to the internal unit 101.

In FIG. 5, a pair of upper and lower extension guides 203 correct a gap between the discharge roller pair 206 and the conveying paths which is generated due to movements of the discharge conveying path 201 and the duplex conveying path 70 in the horizontal direction. The extension guides 203 are provided in a rotatable manner in the vertical direction with rotary shafts 203*a* and 203*b* being pivots, and are brought into press contact with an lower surface of an upper end of the guide member 201*d* of the discharge conveying path 201 and an upper surface of the upper end of the guide member 70*e* of the duplex conveying path 70 by a spring 204.

Figure 6:
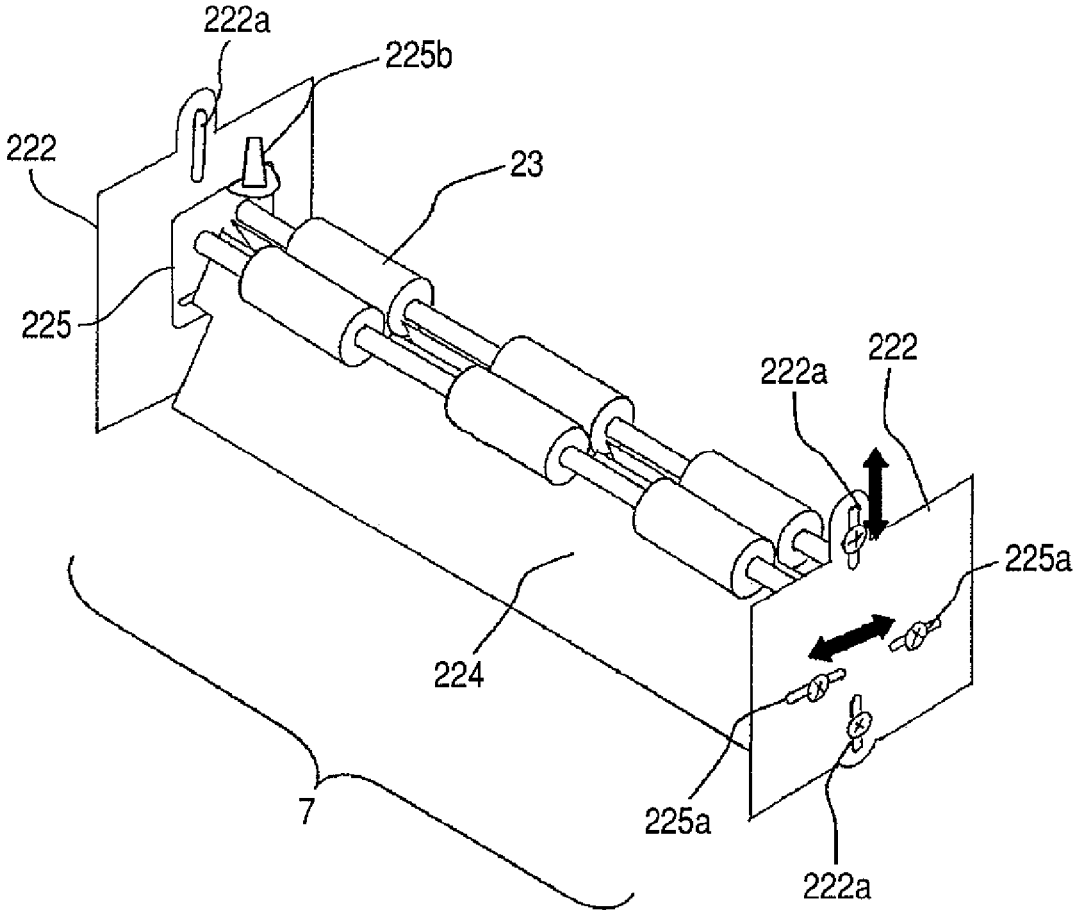
FIG. 6 is a perspective view for explaining a structure of a registration unit provided in the main body chassis.

FIG. 6 is a perspective view for explaining the structure of the registration unit 7 serving as the sheet conveying portion provided in the main body chassis 90. The registration unit 7 is provided to a bottom portion of the main body chassis 90, and is positioned between the sheet feed cassette 20 provided to a lower part of the main body chassis 90 and the internal unit 10.

The registration unit 7 includes a housing 222 serving as a second adjustment portion, the registration roller pair 23, a registration guide 224, and a side plate 225 for supporting both ends of the registration roller pair 23 and the registration guide 224. The side plate 225 including the registration guide 224 and the registration roller pair 23 that form a sheet conveying path for conveying the sheet to the image forming unit 10 is movable in the horizontal direction with respect to the housing 222 through a slide long hole 225*a* extending in the horizontal direction.

Further, the housing 222 is movable in the vertical direction with respect to the main body chassis 90 through a slide long hole 222*a* extending in the vertical direction. The side plate 225 is provided to the housing 222 having the slide long holes 225*a* and 222*a* in the manner as described above, thereby making it possible to move the registration guide 224 and the registration roller pair 23 in the vertical and horizontal directions.

On an upper surface of the side plate 225, there is formed a positioning protrusion 225*b* for positioning the registration unit 7 while being fitted into the above-mentioned positioning hole 101*c* (see FIG. 2) formed in the upper part of the internal unit 101. The positioning protrusion 225*b* is also provided to a side plate (not shown) positioned on an opposite side of a longitudinal direction.

In the case where the internal unit 101 is replaced or in the case where another internal unit is accommodated in the main body chassis in place of the internal unit 101, the internal unit 101 is first removed. Next, before the internal unit 101 is accommodated in the main body chassis 90, the registration unit 7 (housing 222) is slid and evacuated downward along the slide long hole 222*a*.

Then, after the internal unit 101 or the like is accommodated in the main body chassis 90, the housing 222 is moved upward along the slide long hole 222*a*. In addition, the registration guide 224 and the registration roller pair 23 are moved integrally with the side plate 225 to the position facing the transfer path 76 (see FIG. 2) of the internal unit 101. After that, the positioning protrusion 225*b* is fitted into the positioning hole 101*c* of the internal unit 101.

Thus, the positioning of the registration unit 7 in the vertical and horizontal directions with respect to the internal unit 101 is made. As a result, the registration guide 224 and the registration roller pair 23 of the registration unit 7 are fixed to the position facing the transfer path 76 of the internal unit 101. When the registration unit 7 is positioned to the internal unit 101 to be mounted in the manner as described above, the registration roller pair 23 functions as a sheet conveying interface with respect to the internal unit 101.

Figure 7:
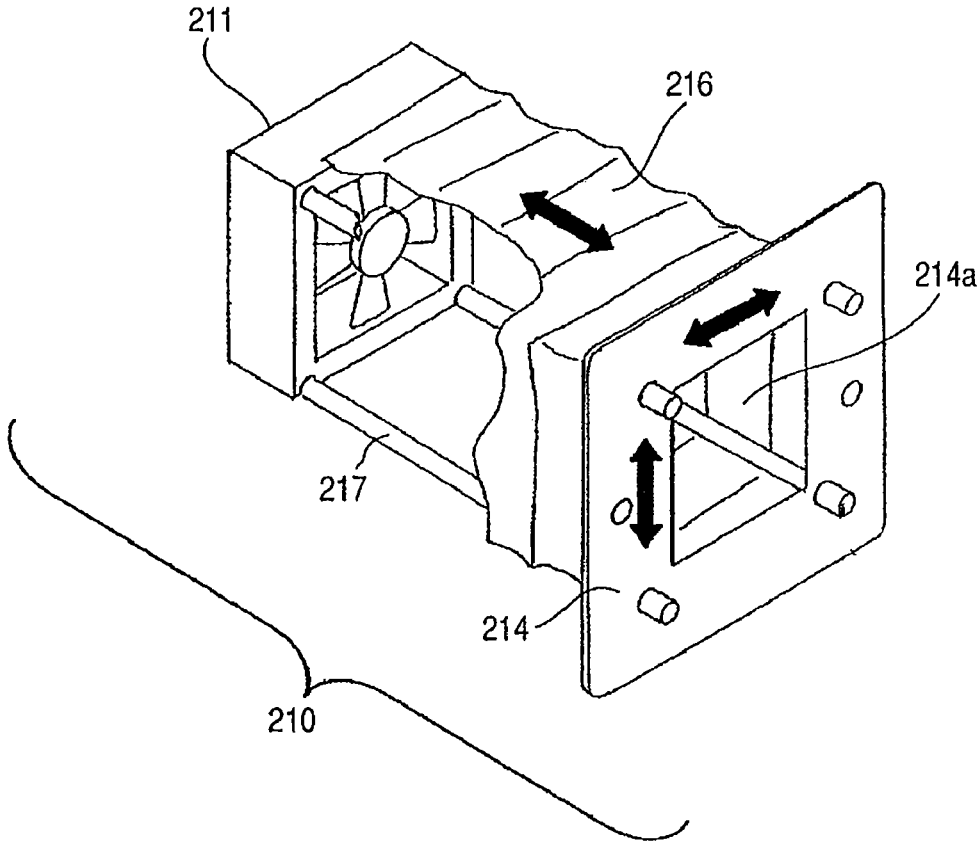
FIG. 7 is a perspective view of a fan duct provided in the main body chassis.
Figure 8:
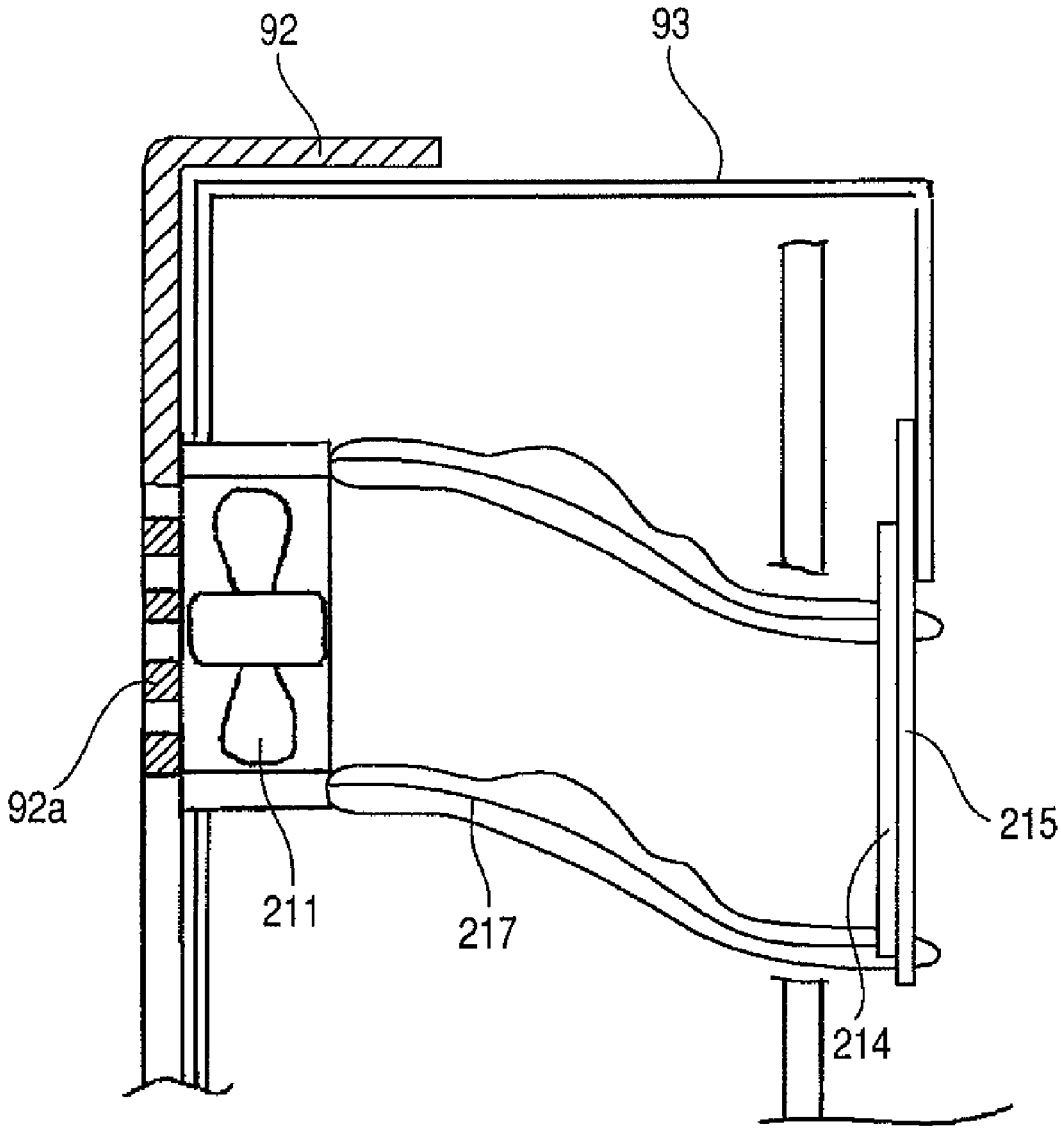
FIG. 8 is an explanatory diagram of the fan duct.

FIG. 7 is a perspective view of the fan duct 210 which serves as an exhaust unit and is provided on a back surface in an electric housing 93 of the main body chassis 90, and FIG. 8 is an explanatory diagram of a structure of the fan duct 210.

In FIGS. 7 and 8, a fan 211 is mounted to the electric housing 93 so as to face opening portions 92 having slits provided in an external cover 92 on a back surface of the apparatus main body. At four corners of the fan 211, four wires 217 which are elastically deformable are provided, and a first fixing plate 214 is provided at tip ends of the wires 217 in a movable manner along with the wires 217.

At the center portion of the first fixing plate 214, an exhaust port 214*a* serving as an opening portion functioning as an inlet for an air duct is formed. In this embodiment, the exhaust duct 216 is formed by covering the four wires 217 with a cloth, rubber, or elastic resin, thereby preventing air leakage from the first fixing plate 214 to the fan 211.

Figure 9:
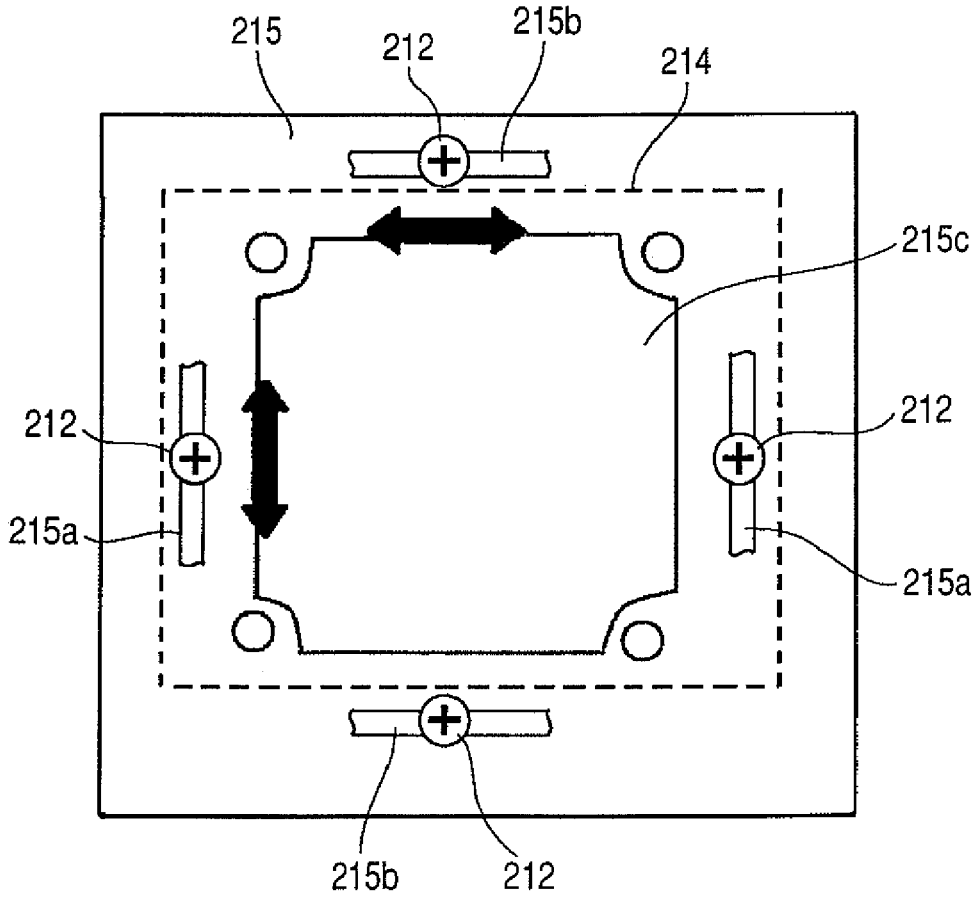
FIG. 9 is another explanatory diagram of the fan duct.

In this case, the first fixing plate 214 is movable in the vertical direction with respect to a second fixing plate 215, which serves as a third adjustment portion and is mounted on the electric housing 93 as illustrated in FIG. 9, along long holes 215*a* which are formed in the second fixing plate 215 and extend in the vertical direction. Further, the first fixing plate 214 is fixed to the second fixing plate 215 with screws 212.

The second fixing plate 215 having the long holes 215*b* extending in the horizontal direction is movable in the horizontal direction with respect to the electric housing 93 along the long holes 215*b*, and can be fixed to an arbitrary position of the electric housing 93 with the screws 212. Further, the second fixing plate 215 also has an opening portion 215*c* in the same manner as the first fixing plate 214, and the electric housing 93 also has an opening portion. Thus, the airflow from the fan 211 to the main body chassis 90 is assured.

Thus, the first fixing plate 214 having the opening portion 214*a* is mounted to the second fixing plate 215 having the long holes 215*a* and 215*b*, thereby making it possible to move the exhaust port 214*a* in the vertical and horizontal directions.

In the case where the internal unit 101 is replaced, or in the case where another internal unit is accommodated in the main body chassis in place of the internal unit 101, the internal unit 101 is first removed. Next, before the internal unit 101 is accommodated in the main body chassis 90, the first fixing plate 214 is moved in the vertical direction along the long holes 215*a*. Further, the second fixing plate 215 is moved in the vertical direction along the long holes 215*b*.

After that, the two fixing plates 214 and 215 are fixed to positions appropriate for exhausting heat generated from the internal unit 101. As a result, it is possible to move the exhaust port 214*a* to the position facing the internal unit 101. Another opening portion may be provided in the exhaust duct 210 to thereby exhaust heat within the electric housing 93.

Figure 10:
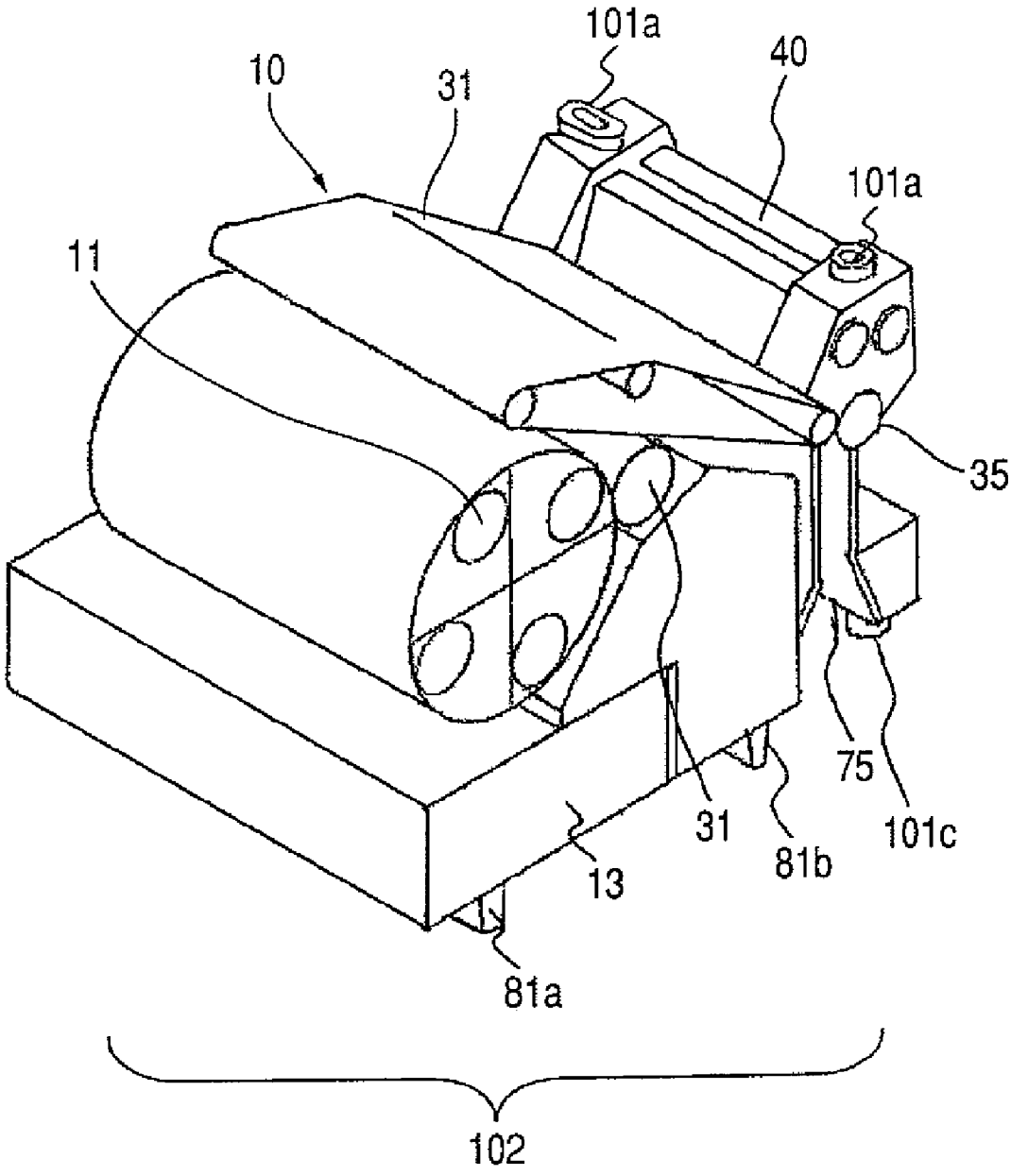
FIG. 10 is a diagram illustrating a structure of the internal unit of a rotary type including an image forming unit capable of being mounted on the color printer and having another structure.

FIG. 10 shows a structure of a rotary internal unit serving as another structure of an image forming unit which can be mounted on the color printer 1 having the above-mentioned structure. In FIG. 10, components identical with or corresponding to those of FIG. 2 are denoted by the same reference symbols.

In this case, another rotary internal unit 102 includes the image forming unit 10 having a structure different from that of a tandem internal unit 101 illustrated in FIG. 2. A position appropriate for the sheet to enter the image forming unit 10 of the rotary internal unit is different from that of the tandem internal unit 10. Further, the position of the fixing device 40 of the rotary internal unit is different from that of the tandem internal unit 10. As a result, a position from which the sheet is delivered, a heat source, heat capacity, and an internal airflow (gap through which air flows) are different between the rotary internal unit and the tandem internal unit, thereby varying a position of the fan duct appropriate for exhausting heat.

Another internal unit 102 has the positioning protrusions 81*a* and 81*b* and the positioning holes 101*a* and 101*c* at the same positions as those of the tandem internal unit 101.

Next, a method of replacing the tandem internal unit 101 with another internal unit 102 will be described.

First, the tandem internal unit 101 is removed from the main body chassis 90. In this case, the multi-feed tray 25 is removed first, and then connection between the discharge conveying path 201 and the fixing device 40 is released while the discharge unit 6 is moved upward. Further, connection between the discharge conveying path 201 and the transfer entrance guide 75 is released. Since the fan duct 210 includes no connecting unit with respect to the internal unit 101, there is no need to release connection.

Next, after the sheet feed cassette 20 is drawn out in a front-right direction of FIG. 2, the internal unit 101 is drawn out together with the rails 91. After that, fitting of the internal unit 101 with the rails 91 is released, and the internal unit 101 is removed from the main body chassis 90.

Then, another internal unit 102 is mounted on the rails 90 while the positioning protrusions 81 and 81*b* are fitted to the rails 90, respectively, and then another internal unit 102 is accommodated in the main body chassis 90 together with the rails 91. At this time, the discharge unit 6 is evacuated in advance to evacuate the registration unit 7 downward. The multi-feed tray 25 is removed in advance.

Then, the positioning protrusion 207*c* (see FIG. 4) of the discharge unit 6 is fitted into the positioning holes 101*a* formed on both sides of the upper portion of the fixing device 40 of another internal unit 102, thereby positioning the discharge unit 6 in a back and forth, vertical, and horizontal directions to be fixed.

Then, the positioning protrusion 225*b* (see FIG. 6) of the registration unit 7 is fitted into the positioning hole 101*c* provided in the vicinity of the transfer entrance guide 75 of another internal unit 102 to fix the registration unit 7. Then, the multi-feed tray 25 is mounted to a side of another internal unit 102 and the feed cassette 20 is mounted on the main body chassis 90.

The fan duct 210 selects the position appropriate for exhausting heat of another internal unit 102 to move the first and second fixing plates 214 and 215, fixing the exhaust port 214*a* to the position appropriate for exhausting heat (exhaust) which is adjacent to the internal unit 101. As a result, another internal unit 102 is accommodated in the main body chassis 90 without being restricted in a difference between the positions of the discharge unit 6 and the registration unit 7.

Thus, when the internal unit is replaced, the positions of the discharge unit 6 and the registration unit 7 with respect to another internal unit 102 to be replaced are adjusted, thereby making it possible to selectively accommodate the internal unit 102, which includes the image forming units having the different structures, in the apparatus main body. As a result, even when the structure of the image forming unit 10 is varied, the respective positions of the discharge unit 6, the registration unit 7, and the fan duct 210 are arbitrarily set, thereby making it possible to commonly use the apparatus main body 2 (main body chassis 90).

With the structure described above, various image forming units (image forming units) adopting different image forming processes (structures) can be mounted on one main body chassis (apparatus main body). As a result, it is possible to reuse or commonly use the apparatus main body, and thereby achieve reduction in manufacturing costs. Further, also in a case of recycling the image forming apparatus, the image forming unit can be easily removed, thereby making it possible to reduce recycling costs and further easily make one image forming apparatus into another image forming apparatus adopting a different image forming process.

In the above description, the color printer using the intermediate transferring belt is described, but the present invention is not limited thereto. The present invention can be applied to, for example, a color printer which does not use the intermediate transferring belt, a color electrophotographic printer including one image bearing member, for example, a photosensitive drum, and also a monochromatic printer.

In this embodiment, the structure in which position adjustment is performed through the long hole when the discharge unit 6 and the registration unit 7 are mounted to the internal units 101 and 102 is described as an example, but the present invention is not limited thereto. For example, the position adjustment may be performed by forming a plurality of positioning holes and selectively using the holes. Further, the position adjustment may be performed also by using both the long hole and the positioning hole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-093633, filed Mar. 30, 2006, which is hereby incorporated by reference herein in its entirety.

What is claimed is:

1. An image forming apparatus, comprising:

an image forming unit;

an apparatus main body which is capable of mounting the image forming unit;

a sheet conveying portion which is provided to the apparatus main body, and conveys a sheet to the image forming unit;

a sheet discharge portion which is provided to the apparatus main body, and delivers the sheet on which an image is formed by the image forming unit;

a first adjustment portion which adjusts a connecting position of the sheet conveying portion with respect to the image forming unit mounted on the apparatus main body; and a second adjustment portion which adjusts a connecting position of the sheet discharge portion with respect to the image forming unit mounted on the apparatus main body.

2. An image forming apparatus according to claim 1, wherein:

the sheet conveying portion comprises a sheet conveying path which conveys the sheet to the image forming unit; and the first adjustment portion adjusts a position of the sheet conveying path with respect to the apparatus main body.

3. An image forming apparatus according to claim 1, wherein:

the sheet discharge portion comprises a sheet discharge path which discharges the sheet having an image formed thereon; and the second adjustment portion adjusts a position of the sheet discharge path with respect to the apparatus main body.

4. An image forming apparatus according to claim 3, wherein:

the sheet discharge portion further comprises a re-conveying path which conveys again the sheet having an image formed thereon to the image forming unit; and the second adjustment portion which adjusts a position of the re-conveying path with respect to the apparatus main body.

5. An image forming apparatus according to claim 1, further comprising:

an exhaust means provided to the apparatus main body; and a third adjustment portion which adjusts a position of the exhaust means with respect to the image forming unit, wherein the third adjustment portion adjusts the position of the exhaust means with respect to the image forming unit.

6. An image forming apparatus according to claim 5, wherein:

the exhaust means comprises an exhaust duct having an opening portion facing the image forming unit; and the third adjustment portion adjusts a position of the opening portion of the exhaust duct with respect to the apparatus main body.

7. An image forming apparatus according to claim 1, further comprising a guide means which accommodates the image forming unit in the apparatus main body.

8. An image forming apparatus, comprising:

an apparatus main body capable of selectively mounting different image forming units of different types;

a sheet conveying portion which is provided to the apparatus main body, and conveys a sheet to the image forming unit mounted on the apparatus main body;

a sheet discharge portion which is provided to the apparatus main body, and discharges the sheet on which an image is formed by the image forming unit mounted on the apparatus main body;

a first adjustment portion which adjusts a connecting position of the sheet conveying portion with respect to the image forming unit mounted on the apparatus main body; and a second adjustment portion which adjusts a connecting position of the sheet discharge portion with respect to the image forming unit mounted on the apparatus main body.

9. An image forming apparatus according to claim 8, wherein:

the sheet conveying portion comprises a sheet conveying path which conveys the sheet to the image forming unit; and the first adjustment portion adjusts a position of the sheet conveying path with respect to the apparatus main body.

10. An image forming apparatus according to claim 8, wherein:

the sheet discharge portion comprises a sheet discharge path which discharges the sheet having an image formed thereon; and the second adjustment portion adjusts a position of the sheet discharge path with respect to the apparatus main body.

11. An image forming apparatus according to claim 10, wherein:

the sheet discharge portion further comprises a re-conveying path which conveys again the sheet having an image formed thereon to the image forming unit; and the second adjustment portion adjusts a position of the re-conveying path with respect to the apparatus main body.

12. An image forming apparatus according to claim 8, further comprising:

an exhaust means provided to the apparatus main body; and a third adjustment portion which adjusts a position of the exhaust means with respect to the image forming unit, wherein the third adjustment portion adjusts the position of the exhaust means with respect to the image forming unit.

13. An image forming apparatus according to claim 12, wherein:

the exhaust means comprises an exhaust duct having an opening portion facing the image forming unit; and the third adjustment unit adjusts a position of the opening portion of the exhaust duct with respect to the apparatus main body.

14. An image forming apparatus according to claim 8, further comprising a guide means which accommodates the image forming unit in the apparatus main body.

* * * * *